US005551503A

United States Patent [19]

Padino

[11] Patent Number: 5,551,503

[45] Date of Patent: Sep. 3, 1996

[54] PROCESS FOR THE PRODUCTION OF DECORATIVE ARTICLES IN GOLD OR OTHER PRECIOUS METALS AND THE ARTICLES MADE BY THE PROCESS

[75] Inventor: Antonio Padino, Bassano Del Grappa, Italy

[73] Assignee: Padino Antonio Microfusioni, Bassano Del Grappa, Italy

[21] Appl. No.: 377,697

[22] Filed: Jan. 25, 1995

[30] Foreign Application Priority Data

Jan. 27, 1994 [IT] Italy ..... VI94A0010

[51] Int. Cl.[6] ..... B22C 9/00; B22C 9/02

[52] U.S. Cl. ..... 164/516; 164/34; 164/35

[58] Field of Search ..... 164/34, 35, 45, 164/516, 235

[56] References Cited

U.S. PATENT DOCUMENTS 4,557,312 12/1985 Gonzales ..... 164/45

4,793,045 12/1988 Singer ..... 164/45

FOREIGN PATENT DOCUMENTS 3-23031 1/1991 Japan ..... 164/34

*Primary Examiner*—Jack W. Lavinder
*Assistant Examiner*—I.-H. Lin
*Attorney, Agent, or Firm*—Bucknam and Archer

[57] ABSTRACT

The process consists of starting from a lace or embroidery in cotton or synthetic fibers, applying to the model wax, resins or varnishes capable of increasing the size, then coating the model with gypsum and then introducing the coated model into a furnace. The heat destroys the model and leaves a cavity which has the shape of the model. The precious metal is introduced into the cavity in the molten form. Finally the article is allowed to solidify and the gypsum is crushed. The decorative article may be used for necklaces, bracelets or similar materials.

1 Claim, 2 Drawing Sheets

PROCESS FOR THE PRODUCTION OF DECORATIVE ARTICLES IN GOLD OR OTHER PRECIOUS METALS AND THE ARTICLES MADE BY THE PROCESS

FIELD OF THE INVENTION

The present invention relates to decorative materials made in gold or other precious metals in a manner similar aesthetically to laces or embroidery in cloth and the process for the manufacture of these decorative materials.

The invention also covers the laces or the embroidery made by the process according to the present invention.

BACKGROUND OF THE INVENTION

A process which involves fusion called "a cera persa" which means involving the loss of the wax has been known according to which the models are made in wax or similar plastic material. Then the models are covered with gypsum and the models are introduced into a furnace kept at high temperature, so that the initial model disappears and! in the gypsum remains the cavity within which subsequently the metal which can be silver, gold or platinum or an alloy of these materials is injected. The finished article is obtained by solidification.

The form in the gypsum is subsequently crushed and the process is called "a cera persa".

SUMMARY OF THE INVENTION

The novelty of the present invention resides in the fact that a conventional lace or embroidery of cotton or other synthetic material is treated with wax, resins, varnishes, or suitable plastic material in order to increase the size of the body and afterwards the model is covered with gypsum. The subsequent steps are the same as the models presently used, that is the model is introduced into a furnace for the purpose of destroying the original model and obtaining on the contrary a cavity within which the molten metal is introduced. After the metal solidifies, the finished decorative material is obtained.

BRIEF DESCRIPTION OF THE DRAWINGS

The decorative material which is produced according to the process of the present invention is illustrated more particularly by reference to the accompanying drawings of which.

Figure 1:
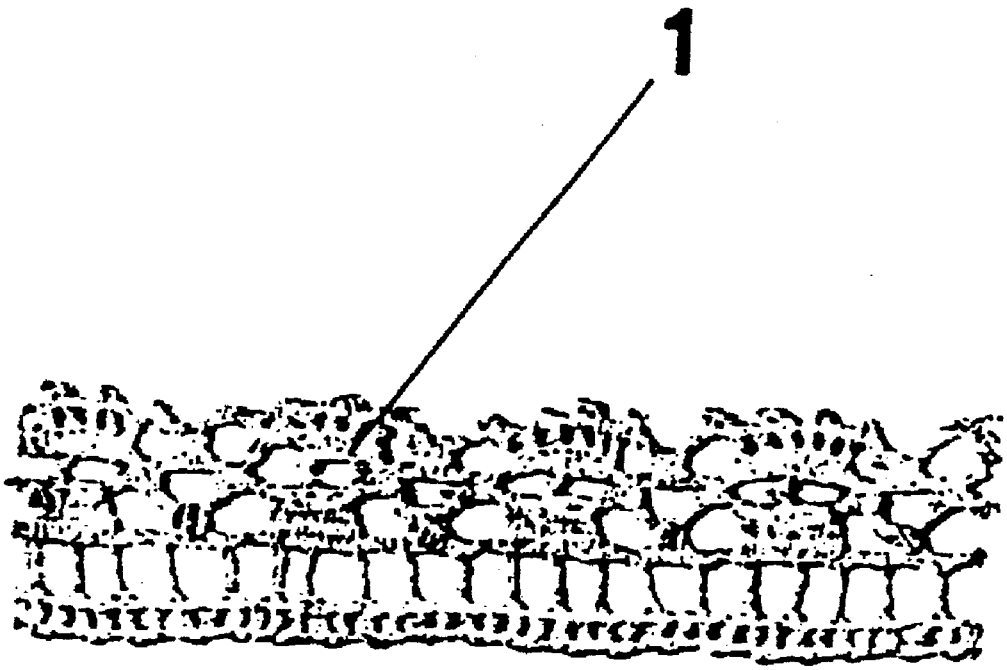
FIG. 1 is a decorative material made by the process according to the present invention.

The process according to the present invention consists of, as already stated hereinabove, using as a starting material a model of lace or embroidery made of cotton or other synthetic material of a shape similar to the material 1) shown in FIG. 1. The model is then treated with wax, resins, varnishes or other plastic material for the purpose of increasing the size of the body. Subsequently the model is coated with gypsum and is heated in a furnace according to the heating process previously already used so that the original model is destroyed and a cavity is formed. The metal which can be gold or another precious metal is introduced into the cavity in the molten condition in order to form the final article.

Figure 2:
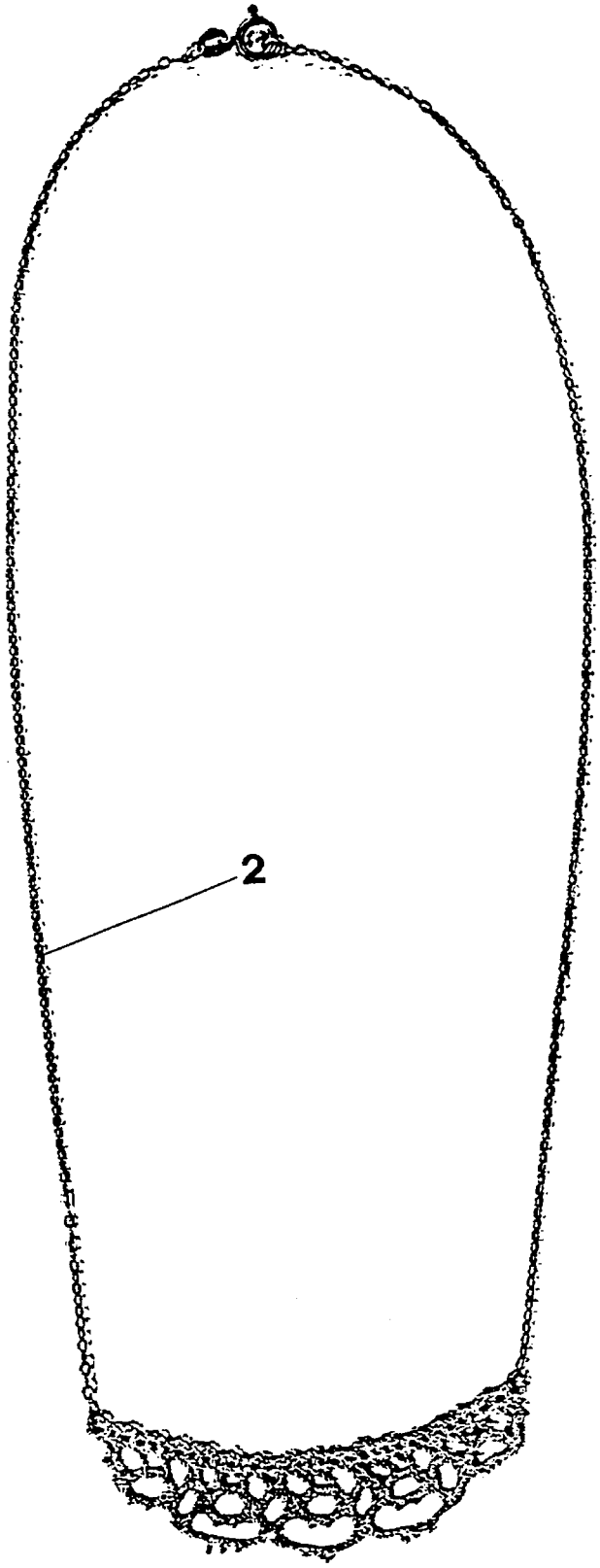
FIG. 2 is a necklace which is provided with a decorative material made according to the process of the present invention.

The finished article is applied to a conventional chain as shown in FIG. 2 in order to obtain the necklace 2.

Obviously the aesthetic shapes as shown in the accompanying drawings have been illustrated by way of example which is non-limiting because the finished article will have different shapes and different appearance while remaining within the scope of the present invention.

What is claimed is:

1. A process for the production of a decorative article made in gold or another precious metal which consists of the steps of making a model of lace or embroidery of cotton, said model having a body, said body having a size, then applying to the model a member selected from the group consisting of wax, resins, varnishes, and plastic materials whereby the size of the body of the model is enlarged, afterwards coating the model with gypsum, then introducing said model into a heated furnace whereby the model is destroyed and a cavity is formed, said cavity having the shape of said lace or embroidery, finally introducing into said cavity a precious metal in the molten condition, allowing the article to solidify and crushing said gypsum.

* * * * *